US009140074B2

(12) United States Patent
Schwefe et al.

(10) Patent No.: US 9,140,074 B2
(45) Date of Patent: Sep. 22, 2015

(54) DRILL BIT WITH A FORCE APPLICATION DEVICE USING A LEVER DEVICE FOR CONTROLLING EXTENSION OF A PAD FROM A DRILL BIT SURFACE

(75) Inventors: Thorsten Schwefe, Virginia Water (GB); Dan Raz, Tirat Carmel (IL); Gregory Rinberg, Tirat Carmel (IL)

(73) Assignee: Baker Hughes Incorporated, Houston, TX (US)

( * ) Notice: Subject to any disclaimer, the term of this patent is extended or adjusted under 35 U.S.C. 154(b) by 405 days.

(21) Appl. No.: 13/561,953

(22) Filed: Jul. 30, 2012

(65) Prior Publication Data

US 2014/0027177 A1 Jan. 30, 2014

(51) Int. Cl.

| | |
|---|---|
| ***E21B 10/26*** | (2006.01) |
| ***E21B 10/62*** | (2006.01) |
| ***E21B 10/40*** | (2006.01) |

(52) U.S. Cl.

CPC ..... *E21B 10/62* (2013.01); *E21B 10/26* (2013.01); *E21B 10/40* (2013.01)

(58) Field of Classification Search

CPC ..... E21B 10/26; E21B 10/40; E21B 17/1014
USPC ..... 175/61, 73, 108
See application file for complete search history.

(56) References Cited

U.S. PATENT DOCUMENTS

| | | | | |
|---|---|---|---|---|
| 1,860,214 | A | 5/1932 | Yeaman | |
| 3,493,165 | A * | 2/1970 | Schonfeld | 299/31 |
| 3,807,512 | A | 4/1974 | Pogonowski et al. | |
| 4,185,704 | A | 1/1980 | Nixon, Jr. | |
| 4,281,722 | A | 8/1981 | Tucker et al. | |
| 4,397,619 | A | 8/1983 | Alliquander et al. | |
| 4,549,614 | A | 10/1985 | Kaalstad et al. | |
| 4,676,310 | A | 6/1987 | Scherbatskoy et al. | |
| 4,940,097 | A | 7/1990 | Martini | |
| 5,582,260 | A | 12/1996 | Murer et al. | |
| 5,682,957 | A | 11/1997 | Lyon | |
| 5,971,085 | A | 10/1999 | Colebrook | |
| 6,116,354 | A * | 9/2000 | Buytaert | 175/55 |
| 7,004,263 | B2 | 2/2006 | Moriarty et al. | |
| 7,198,119 | B1 * | 4/2007 | Hall et al. | 175/57 |
| 7,360,610 | B2 | 4/2008 | Hall et al. | |
| 7,434,634 | B1 | 10/2008 | Hall et al. | |
| 7,451,835 | B1 | 11/2008 | Hall et al. | |

(Continued)

OTHER PUBLICATIONS

International Search Report and Written Opinion dated Oct. 25, 2013 for International Application No. PCT/US2013/052619.

(Continued)

*Primary Examiner* — Cathleen Hutchins
(74) *Attorney, Agent, or Firm* — Cantor Colburn LLP

(57) ABSTRACT

In one aspect, a drill bit is disclosed that in one embodiment includes a pad configured to extend and retract from a surface of the drill bit and a force application device configured to extend and retract the pad, wherein the force application device includes a force action member that includes a lever action device configured to extend and retract the pad from the drill bit surface. In another aspect, a method of drilling a wellbore is provided that in one embodiment includes: conveying a drill string having a drill bit at an end thereof, wherein the drill bit includes a pad configured to extend and retract from a surface of the drill bit and a force application device that includes a lever action device configured to extend and retract the pad from the surface of the drill bit; and rotating the drill bit to drill the wellbore.

13 Claims, 6 Drawing Sheets

(56) References Cited

U.S. PATENT DOCUMENTS

| | | | | |
|---|---|---|---|---|
| 7,484,576 | B2 | 2/2009 | Hall et al. | |
| 7,506,701 | B2 | 3/2009 | Hall et al. | |
| 7,866,416 | B2 | 1/2011 | Hall et al. | |
| 8,011,457 | B2 | 9/2011 | Hall et al. | |
| 8,297,375 | B2 | 10/2012 | Hall et al. | |
| 2002/0179336 | A1 | 12/2002 | Schaaf et al. | |
| 2005/0247488 | A1* | 11/2005 | Mock et al. | 175/99 |
| 2007/0114062 | A1* | 5/2007 | Hall et al. | 175/50 |
| 2007/0114068 | A1 | 5/2007 | Hall et al. | |
| 2007/0181298 | A1* | 8/2007 | Sheiretov et al. | 166/212 |
| 2008/0179098 | A1 | 7/2008 | Hall et al. | |
| 2009/0044979 | A1 | 2/2009 | Johnson et al. | |
| 2009/0057016 | A1 | 3/2009 | Hall et al. | |
| 2009/0107722 | A1 | 4/2009 | Chen et al. | |
| 2010/0071956 | A1 | 3/2010 | Beuershausen | |
| 2010/0212966 | A1 | 8/2010 | Hall et al. | |
| 2011/0031025 | A1 | 2/2011 | Kulkarni et al. | |
| 2011/0120775 | A1 | 5/2011 | Krueger et al. | |
| 2014/0027177 | A1 | 1/2014 | Schwefe et al. | |
| 2014/0027179 | A1 | 1/2014 | Schwefe et al. | |
| 2014/0027180 | A1 | 1/2014 | Schwefe | |

OTHER PUBLICATIONS

International Search Report and Written Opinion dated Oct. 23, 2013 for International Application No. PCT/US2013/052615.
International Search Report and Written Opinion dated Oct. 23, 2013 for International Application No. PCT/US2013/052616.
International Search Report and Written Opinion dated Nov. 5, 2013 for International Application No. PCT/US2013/052621.

* cited by examiner

DRILL BIT WITH A FORCE APPLICATION DEVICE USING A LEVER DEVICE FOR CONTROLLING EXTENSION OF A PAD FROM A DRILL BIT SURFACE

BACKGROUND INFORMATION

1. Field of the Disclosure

This disclosure relates generally to drill bits and systems that utilize same for drilling wellbores.

2. Background of the Art

Oil wells (also referred to as "wellbores" or "boreholes") are drilled with a drill string that includes a tubular member having a drilling assembly (also referred to as the "bottomhole assembly" or "BHA"). The BHA typically includes devices and sensors that provide information relating to a variety of parameters relating to the drilling operations ("drilling parameters"), behavior of the BHA ("BHA parameters") and parameters relating to the formation surrounding the wellbore ("formation parameters"). A drill bit attached to the bottom end of the BHA is rotated by rotating the drill string and/or by a drilling motor (also referred to as a "mud motor") in the BHA to disintegrate the rock formation to drill the wellbore. A large number of wellbores are drilled along contoured trajectories. For example, a single wellbore may include one or more vertical sections, deviated sections and horizontal sections through differing types of rock formations. When drilling progresses from a soft formation, such as sand, to a hard formation, such as shale, or vice versa, the rate of penetration (ROP) of the drill changes and can cause (decreases or increases) excessive fluctuations or vibration (lateral or torsional) in the drill bit. The ROP is typically controlled by controlling the weight-on-bit (WOB) and rotational speed (revolutions per minute or "RPM") of the drill bit so as to control drill bit fluctuations. The WOB is controlled by controlling the hook load at the surface and the RPM is controlled by controlling the drill string rotation at the surface and/or by controlling the drilling motor speed in the BHA. Controlling the drill bit fluctuations and ROP by such methods requires the drilling system or operator to take actions at the surface. The impact of such surface actions on the drill bit fluctuations is not substantially immediate. Drill bit aggressiveness contributes to the vibration, oscillation and the drill bit for a given WOB and drill bit rotational speed. Depth of cut of the drill bit is a contributing factor relating to the drill bit aggressiveness. Controlling the depth of cut can provide smoother borehole, avoid premature damage to the cutters and longer operating life of the drill bit.

The disclosure herein provides a drill bit and drilling systems using the same configured to control the aggressiveness of a drill bit during drilling of a wellbore.

SUMMARY

In one aspect, a drill bit is disclosed that in one embodiment includes a pad configured to extend and retract from a surface of the drill bit, and a force application device configured to extend and retract the pad, wherein the force application device includes a force action member that includes a lever action device configured to extend and retract the pad from the drill bit surface.

In another aspect, a method of drilling a wellbore is provided that in one embodiment includes: conveying a drill string having a drill bit at an end thereof, wherein the drill bit includes a pad configured to extend and retract from a surface of the drill bit and a force application device that includes a lever action device configured to extend and retract the pad from the surface of the drill bit; and rotating the drill bit to drill the wellbore.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

The disclosure herein is best understood with reference to the accompanying figures in which like numerals have generally been assigned to like elements and in which.

DESCRIPTION OF THE EMBODIMENTS

Figure 1:
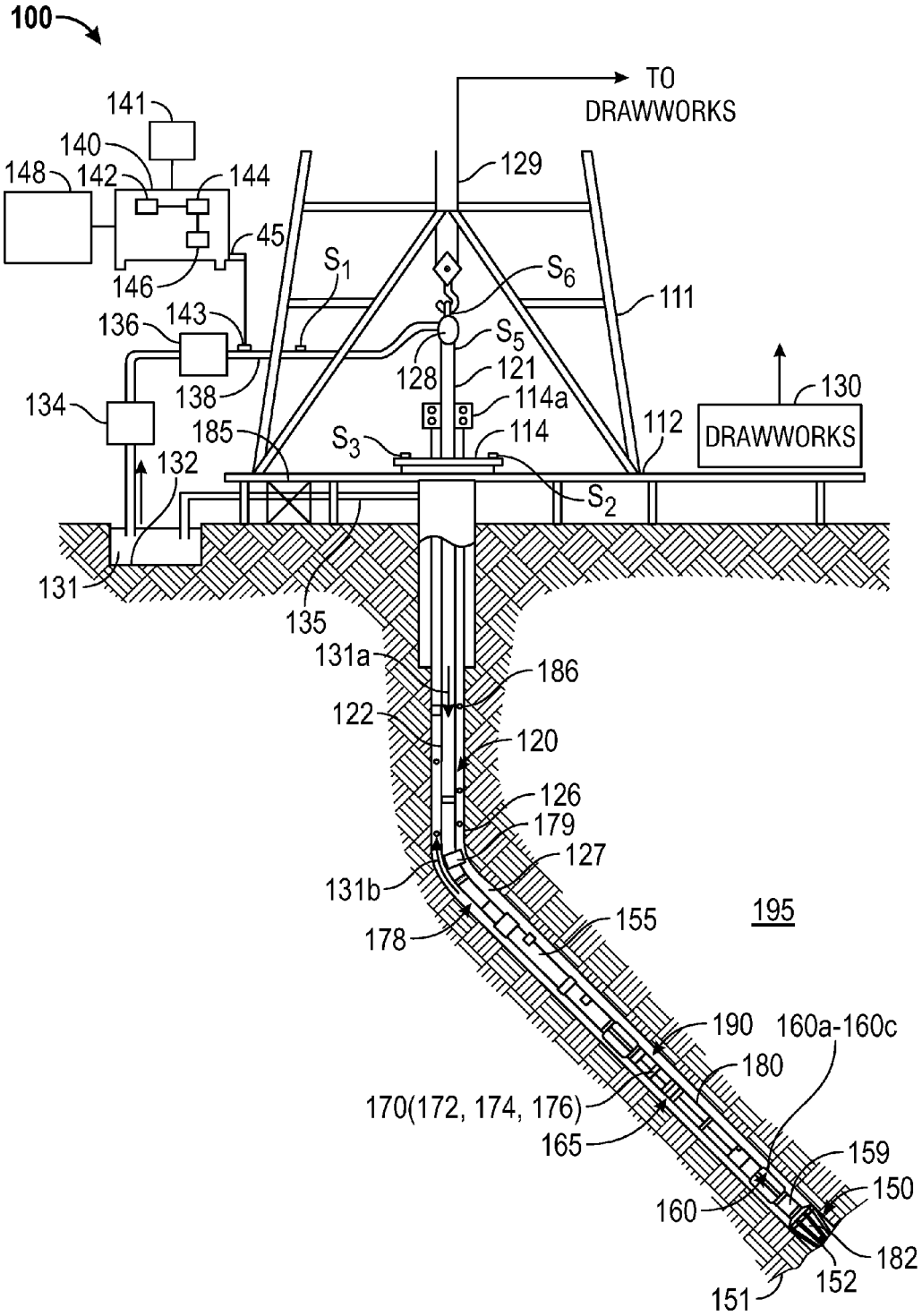
FIG. 1 is a schematic diagram of an exemplary drilling system that includes a drill string that has a drill bit made according to one embodiment of the disclosure.

FIG. 1 is a schematic diagram of an exemplary drilling system 100 that includes a drill string 120 having a drilling assembly or a bottomhole assembly 190 attached to its bottom end. Drill string 120 is shown conveyed in a borehole 126 formed in a formation 195. The drilling system 100 includes a conventional derrick 111 erected on a platform or floor 112 that supports a rotary table 114 that is rotated by a prime mover, such as an electric motor (not shown), at a desired rotational speed. A tubing (such as jointed drill pipe) 122, having the drilling assembly 190 attached at its bottom end, extends from the surface to the bottom 151 of the borehole 126. A drill bit 150, attached to the drilling assembly 190, disintegrates the geological formation 195. The drill string 120 is coupled to a draw works 130 via a Kelly joint 121, swivel 128 and line 129 through a pulley. Draw works 130 is operated to control the weight on bit ("WOB"). The drill string 120 may be rotated by a top drive 114*a* rather than the prime mover and the rotary table 114.

To drill the wellbore 126, a suitable drilling fluid 131 (also referred to as the "mud") from a source 132 thereof, such as a mud pit, is circulated under pressure through the drill string 120 by a mud pump 134. The drilling fluid 131 passes from the mud pump 134 into the drill string 120 via a desurger 136 and the fluid line 138. The drilling fluid 131*a* discharges at the borehole bottom 151 through openings in the drill bit 150.

The returning drilling fluid 131*b* circulates uphole through the annular space or annulus 127 between the drill string 120 and the borehole 126 and returns to the mud pit 132 via a return line 135 and a screen 185 that removes the drill cuttings from the returning drilling fluid 131*b*. A sensor $S_1$ in line 138 provides information about the fluid flow rate of the fluid 131. Surface torque sensor $S_2$ and a sensor $S_3$ associated with the drill string 120 provide information about the torque and the rotational speed of the drill string 120. Rate of penetration of the drill string 120 may be determined from sensor $S_5$, while the sensor $S_6$ may provide the hook load of the drill string 120.

In some applications, the drill bit 150 is rotated by rotating the drill pipe 122. However, in other applications, a downhole motor 155 (mud motor) disposed in the drilling assembly 190 rotates the drill bit 150 alone or in addition to the drill string rotation. A surface control unit or controller 140 receives: signals from the downhole sensors and devices via a sensor 143 placed in the fluid line 138; and signals from sensors $S_1$-$S_6$ and other sensors used in the system 100 and processes such signals according to programmed instructions provided to the surface control unit 140. The surface control unit 140 displays desired drilling parameters and other information on a display/monitor 141 for the operator. The surface control unit 140 may be a computer-based unit that may include a processor 142 (such as a microprocessor), a storage device 144, such as a solid-state memory, tape or hard disc, and one or more computer programs 146 in the storage device 144 that are accessible to the processor 142 for executing instructions contained in such programs. The surface control unit 140 may further communicate with a remote control unit 148. The surface control unit 140 may process data relating to the drilling operations, data from the sensors and devices on the surface, data received from downhole devices and may control one or more operations drilling operations.

The drilling assembly 190 may also contain formation evaluation sensors or devices (also referred to as measurement-while-drilling (MWD) or logging-while-drilling (LWD) sensors) for providing various properties of interest, such as resistivity, density, porosity, permeability, acoustic properties, nuclear-magnetic resonance properties, corrosive properties of the fluids or the formation, salt or saline content, and other selected properties of the formation 195 surrounding the drilling assembly 190. Such sensors are generally known in the art and for convenience are collectively denoted herein by numeral 165. The drilling assembly 190 may further include a variety of other sensors and communication devices 159 for controlling and/or determining one or more functions and properties of the drilling assembly 190 (including, but not limited to, velocity, vibration, bending moment, acceleration, oscillation, whirl, and stick-slip) and drilling operating parameters, including, but not limited to, weight-on-bit, fluid flow rate, and rotational speed of the drilling assembly.

Still referring to FIG. 1, the drill string 120 further includes a power generation device 178 configured to provide electrical power or energy, such as current, to sensors 165, devices 159 and other devices. Power generation device 178 may be located in the drilling assembly 190 or drill string 120. The drilling assembly 190 further includes a steering device 160 that includes steering members (also referred to a force application members) 160*a*, 160*b*, 160*c* that may be configured to independently apply force on the borehole 126 to steer the drill bit along any particular direction. A control unit 170 processes data from downhole sensors and controls operation of various downhole devices. The control unit includes a processor 172, such as microprocessor, a data storage device 174, such as a solid-state memory and programs 176 stored in the data storage device 174 and accessible to the processor 172. A suitable telemetry unit 179 provides two-way signal and data communication between the control units 140 and 170.

During drilling of the wellbore 126, it is desirable to control aggressiveness of the drill bit to drill smoother boreholes, avoid damage to the drill bit and improve drilling efficiency. To reduce axial aggressiveness of the drill bit 150, the drill bit is provided with one or more pads 180 configured to extend and retract from the drill bit face 152. A force application unit 185 in the drill bit adjusts the extension of the one or more pads 180, which pads controls the depth of cut of the cutters on the drill bit face, thereby controlling the axial aggressiveness of the drill bit 150.

Figure 2:
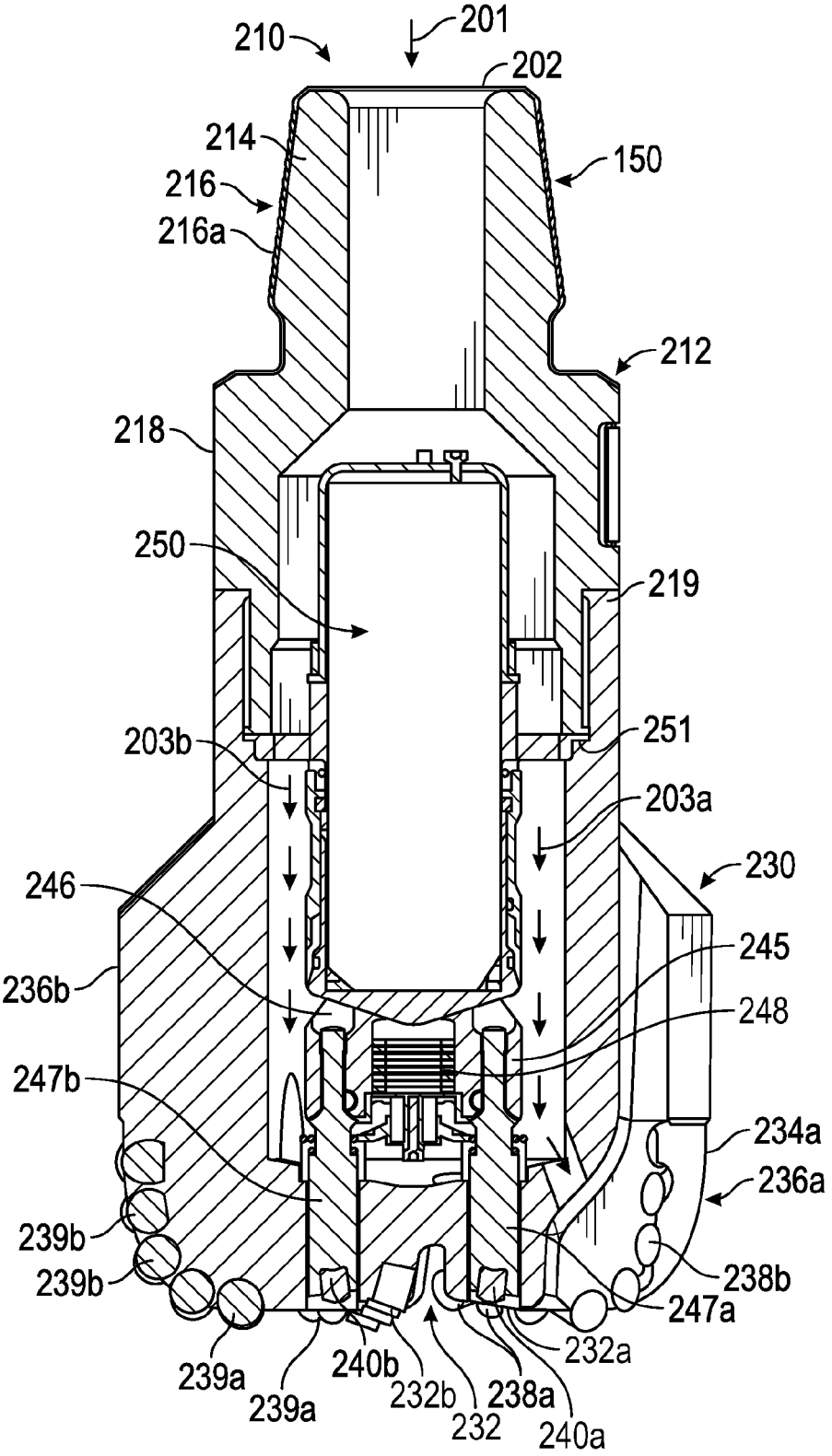
FIG. 2 shows a cross-section of an exemplary drill bit with a force application unit therein for extending and retracting pads on a surface of the drill bit, according to one embodiment of the disclosure.

FIG. 2 shows a cross-section of an exemplary drill bit 150 made according to one embodiment of the disclosure. The drill bit 150 shown is a polycrystalline diamond compact (PDC) bit having a bit body 210 that includes a shank 212 and a crown 230. The shank 212 includes a neck or neck section 214 that has a tapered threaded upper end 216 having threads 216*a* thereon for connecting the drill bit 150 to a box end at the end of the drilling assembly 130 (FIG. 1). The shank 212 has a lower vertical or straight section 218. The shank 210 is fixedly connected to the crown 230 at joint 219. The crown 230 includes a face or face section 232 that faces the formation during drilling. The crown includes a number of blades, such as blades 234*a* and 234*b*, each n. Each blade has a number of cutters, such as cutters 236 on blade 234*a* at blade having a face section and a side section. For example, blade 234*a* has a face section 232*a* and a side section 236*a* while blade 234*b* has a face section 232*b* and side section 236*b*. Each blade further includes a number of cutters. In the particular embodiment of FIG. 2, blade 234*a* is shown to include cutters 238*a* on the face section 232*a* and cutters 238*b* on the side section 236*a* while blade 234*b* is shown to include cutters 239*a* on face 232*b* and cutters 239*b* on side 236*b*. The drill bit 150 further includes one or more pads, such as pads 240*a* and 240*b*, each configured to extend and retract relative to the surface 232. In one aspect, a drive unit or mechanism 245 may carry the pads 240*a* and 240*b*. In the particular configuration shown in FIG. 2, drive unit 245 is mounted inside the drill bit 150 and includes a holder 246 having a pair of movable members 247*a* and 247*b*. The member 247*a* has the pad 240*a* attached at the bottom of the member 247*a* and pad 240*b* at the bottom of member 247*b*. A force application device 250 placed in the drill bit 150 causes the rubbing block 245 to move up and down, thereby extending and retracting the members 247*a* and 247*b* and thus the pads 240*a* and 240*b* relative to the bit surface 232. In one configuration, the force application device 250 may be made as a unit or module and attached to the drill bit inside via flange 251 at the shank bottom 217. A shock absorber 248, such as a spring unit, is provided to absorb shocks on the members 247*a* and 247*b* caused by the changing weight on the drill bit 150 during drilling of a wellbore. The spring 248 also may act as biasing member that causes the pads to move up when force is removed from the rubbing block 245. During drilling, a drilling fluid 201 flows from the drilling assembly into a fluid passage 202 in the center of the drill bit and discharges at the bottom of the drill bit via fluid passages, such as passages 203*a*, 203*b*, etc. Exemplary embodiments of force application devices that utilize lever actions are described in more detail in reference to FIGS. 3-8.

Figure 3:
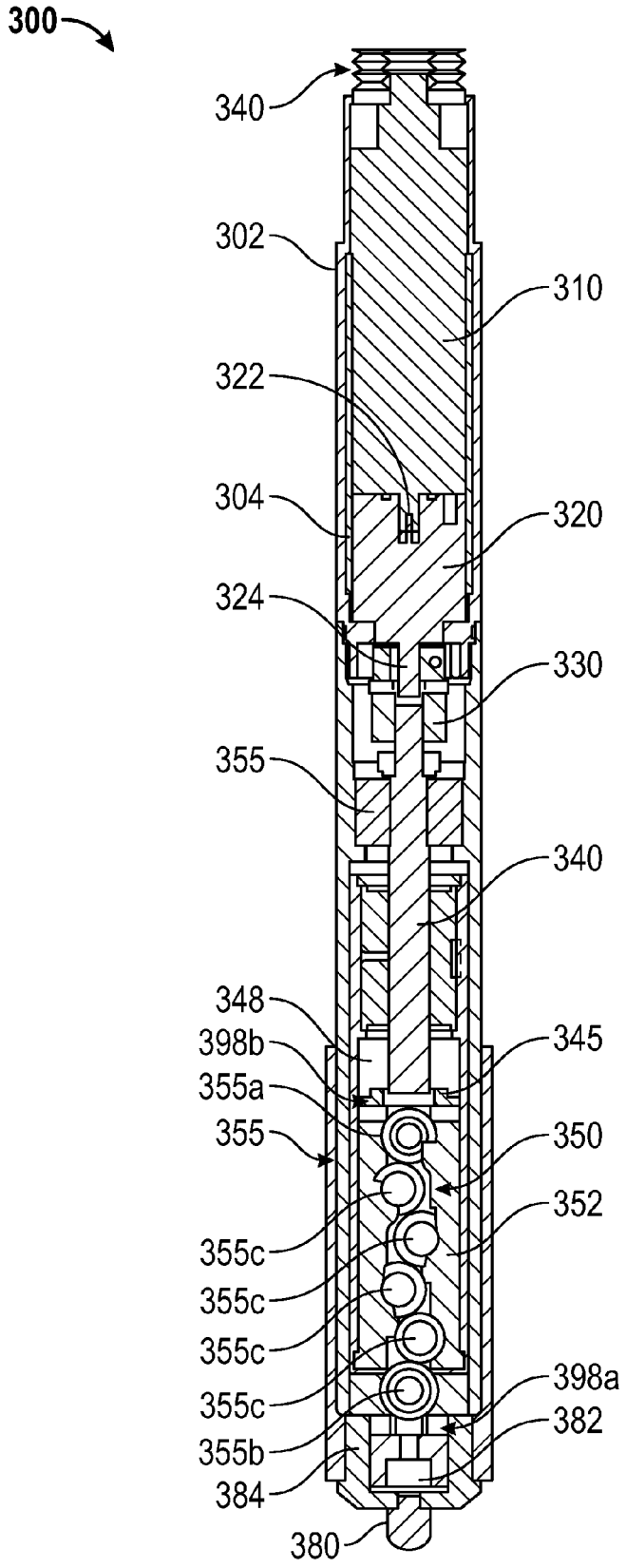
FIG. 3 is a cross-section of a force application device that includes a lever action device that includes rollers configured to extend and retract pads from a drill bit surface.

FIG. 3 shows a cross-section of a force application device 300 made according to an embodiment of the disclosure. The device 300 may be made in the form of a unit or capsule for placement in the fluid channel of a drill bit, such as drill bit 150 shown in FIG. 2. The device 300 includes an upper chamber 302 that houses an electric motor 310 that may be operated by a battery (not shown) in the drill bit or by electric power generated by a power unit in the drilling assembly, such as the power unit 179 shown in FIG. 1. The electric motor 310 is coupled to a rotation reduction device 320, such as a reduction gear, via a coupling 322. The reduction gear 320 housed in a housing 304 rotates a drive shaft 324 attached to the reduction gear 320 at rotational speed lower than the rotational speed of the motor 310 by a known factor. The drive shaft 324 may be coupled to or decoupled from a rotational drive member 340, such as a drive screw, by a coupling device 330. In aspects, the coupling device 330 may be operated by electric current supplied from a battery in the drill bit (not shown) or a power generation unit, such as power generation unit 179 in the drilling assembly 130 shown in FIG. 1. In one configuration, when no current is supplied to the coupling device 330, it is in a deactivated mode and does not couple the drive shaft 324 to the drive screw 340. When the coupling device 330 is activated by supplying electric current thereto, it couples or connects the drive shaft 324 to the drive screw 340. When the motor 310 is rotated in a first direction, for example clockwise, when the drive shaft 324 and the drive screw 340 are coupled by the coupling device 330, the drive shaft 324 will rotate the drive screw 340 in a first rotational direction, e.g., clockwise. When the current to the motor 310 is reversed when the drive shaft 324 is coupled to the drive screw 340, the drive screw 340 will rotate in a second direction, i.e., in this case opposite to the first direction, i.e., counterclockwise.

Still referring to FIG. 3, the force application device 300 may further include a drive unit or drive member 350 (also referred herein as a lever action device) that utilizes a lever or lever-type action activated or deactivated by the drive screw 340 so that when the drive screw 340 rotates in one direction, a member 345 coupled to the drive screw 340 moves linearly in a first direction (for example downward) and when the drive screw 340 moves in a second direction (opposite to the first direction), the member 345 moves in a second direction, i.e., in this case upward. The member 345 is in contact with the drive member 350. In aspects, the member 345 may be a piston member disposed in a hydraulic chamber 348. The drive member 350 is in contact with the pin member or pusher 380 via a carrier 382 driven by the drive member 350. The pin member 380 moves upward when the drive member 350 moves upward and moves downward when the drive member 350 moves downward. Bearings 335 may be provided around the drive screw 340 to provide lateral support to the drive screw 340. The pin 380 is configured to apply force on the drive unit, such as drive unit 245 shown in FIG. 1. When the drive member 350 moves downward, the pin 380 causes the pads 240*a* and 240*b* (FIG. 2) to extend from the drill bit surface and when the drive member 350 moves upward, the pin 380 moves upward. The biasing member in the drive unit 245 causes the pads 240*a* and 240*b* to retract from the drill bit surface. A suitable sensor may be provided at any suitable location to provide information relating to the linear movement of the pin 380. For example a linear sensor 398*a* may provide signals relating to the movement of the carrier 382 or a sensor 398*b* may provide signals relating to the movement of the piston 345 or a sensor that provides signals relating to the rotations of the electric motor from which the linear motion of the pin can be calculated by correlation, etc. Such a sensor may be any suitable sensor, including, but not limited to, a hall-effect sensor and a linear potentiometer sensor. The sensor signals may be processed by electrical circuits in the drill bit or in the drilling assembly and a controller in response thereto may control the motor rotation and thus the movement of the pin 380 and the pads. A pressure compensation device 390, such as bellows, provides pressure compensation to the force application device 300.

Figure 4:
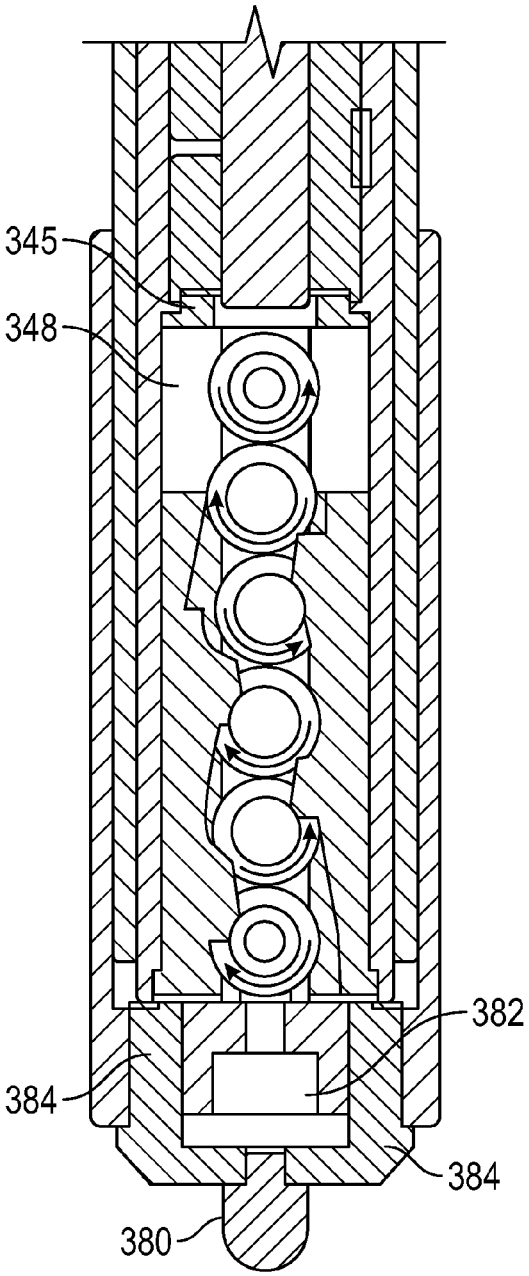
FIG. 4 is a cross-section of the rollers of the force application device of FIG. 3 in their inactive or unextended position.
Figure 5:
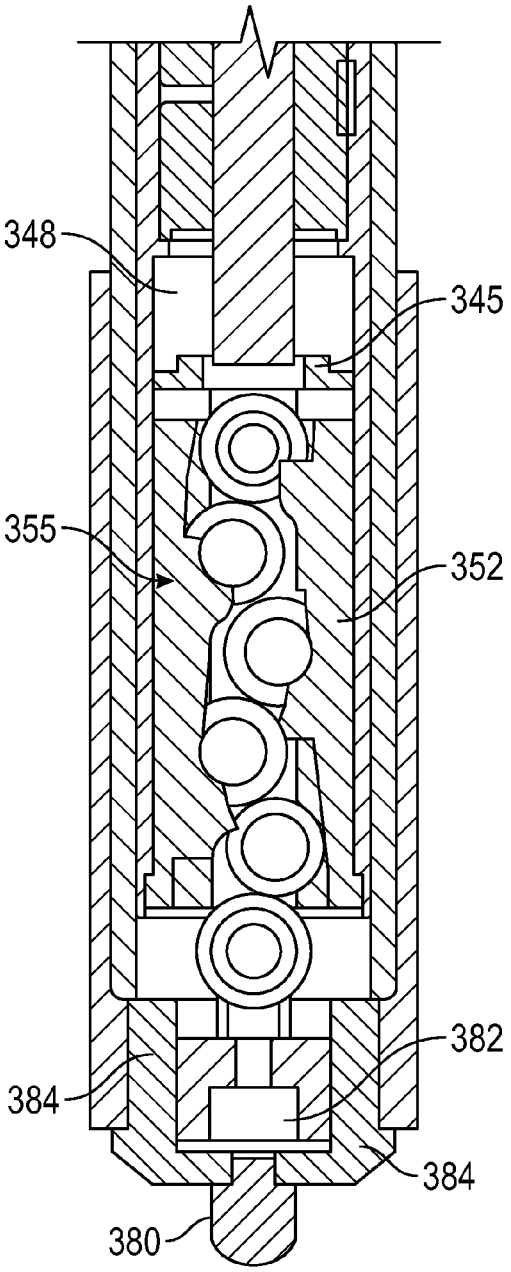
FIG. 5 is a cross-section of the force application device of FIG. 3 in their active or extended position.

Still referring to FIG. 3, the lever action device 350, in aspects, may include a profiled guide 352 that includes a number of articulated rollers 355. In the exemplary configuration of FIG. 3, a roller 355*a* is in contact with the piston member 345 and another roller 355*b* is in contact with the carrier 382 that moves linearly within a chamber 384. The remaining rollers, collectively designated as 355*c*, interact and rotate with each other in the manner of their respective articulation. Typically adjacent rollers move in opposite direction as described in more detail in reference to FIGS. 4 and 5. FIG. 4 is a cross-section of the lever action device 350 wherein the rollers 355 are in their inactive or non-extended position. FIG. 4 shows the piston member 345 in the upper position inside the hydraulic chamber 348. In this inactive position, the carrier 382 will be in its upper position within the chamber 384. In the exemplary configuration of FIG. 4, when the piston member 345 moves downward, the rollers 355 will adjacent rollers 355 will rotate in opposite directions as indicated by their respective arrows. FIG. 5 shows a cross-section of the force application device 350 wherein the rollers are in their active position. In FIG. 4, the piston member 345 is placed in a downward position in the fluid chamber 348, which causes the adjacent rollers 355 to rotate in the opposite direction within the profiled guide 352. The net effect of the rotation of the rollers 355 is to push the push the carrier 384 downward, thus pushing the pin 380 downward. When the piston member 345 moves upward, the rollers rotate in the opposite direction from when the piston moves downward, thereby causing the carrier 382 and hence the pin 380 to move upward. The movement of the pin 384, the extension and retraction of the pads in the drill bit (FIG. 2) and hence the aggressiveness of the drill bit may be controlled by the rotation of the motor 310 (FIG. 3) that may be controlled by a controller in the downhole tool, a surface controller or a combination thereof based on the programmed instruction provide to the controller.

Figure 6:
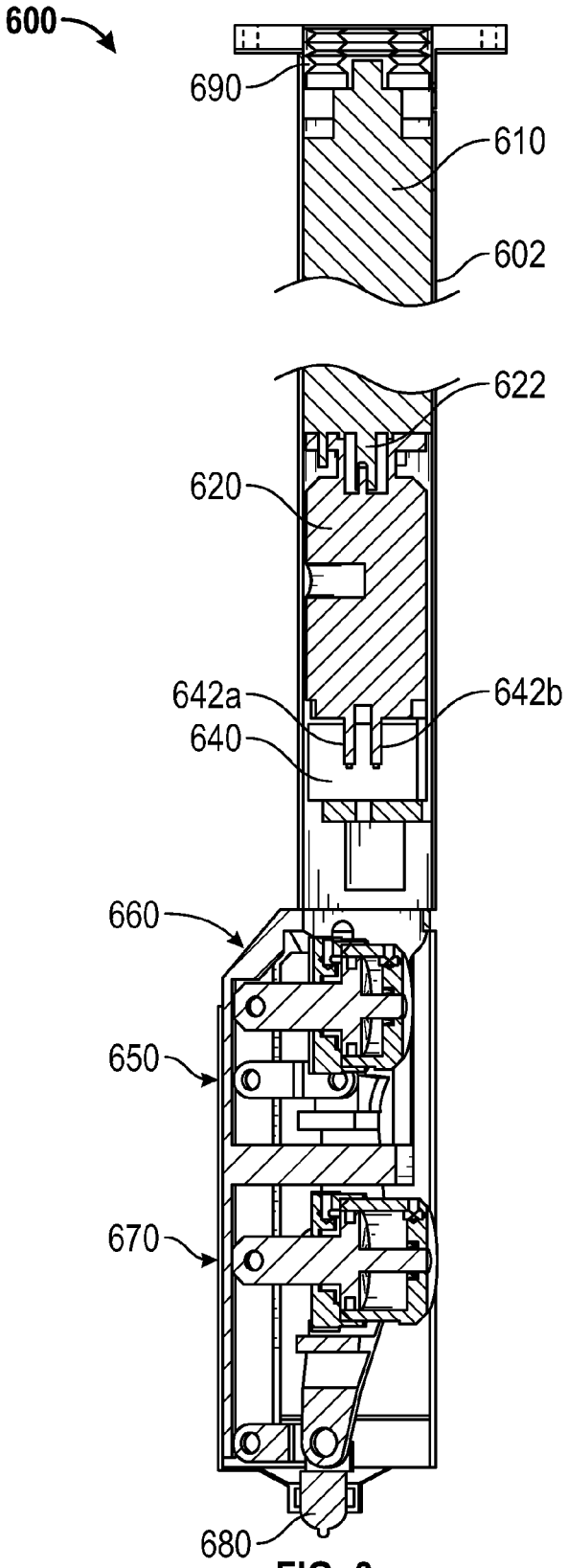
FIG. 6 is a cross-section of a force application device that includes a lever action device that includes a number of hydraulically-operated levers configured to extend and retract pads from a drill bit surface.

FIG. 6 shows a cross-section of a force application device 600 made according an embodiment of the disclosure. The device 600 may be made in the form of a unit or capsule for placement in the fluid channel of a drill bit, such as drill bit 150 shown in FIG. 2. The device 600 includes an upper chamber 602 that houses an electric motor 610 that may be operated by a battery (not shown) in the drill bit or by electric power generated by a power unit in the drilling assembly, such as the power unit 179 shown in FIG. 1. The electric motor 610 is coupled to a hydraulic pump 620 via a coupling 622. The device 600 further includes a drive device or mechanism 650 that may house therein a number of lever action units. The exemplary drive section 650 is shown to include two hydraulically-operated lever action devices 660 and 670. The device 600 further includes a valve block 640 that provides a separate fluid path (such as 642*a* and 642*b*) from the pump 620 to each of the lever action devices, such as units 660 and 670. The lever action devices 650 and 670 cooperate with each other and together extend and retract the pin 680 as described in more detail later. When the pump 620 is operated by the motor 610, the pump 620 provides fluid under pressure to one or more of the lever action devices 660 and 670 based on instructions provided to a controller in the drill bit, bottomhole assembly and/or at the surface. A pressure compensation device 690, such as bellows, provides pressure compensation to the force application device 600.

Figure 7:
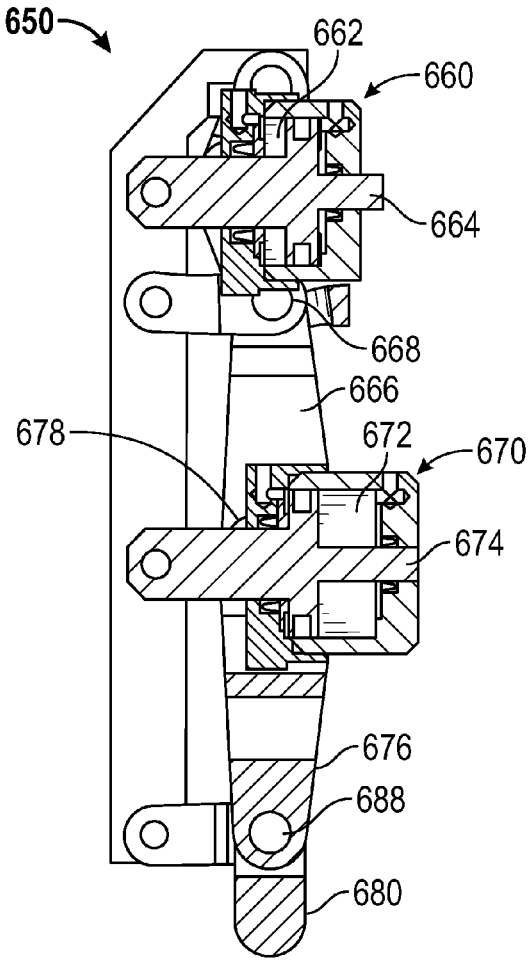
FIG. 7 shows a cross-section of the levers of FIG. 6, wherein the upper lever is in active position and the lower lever in an inactive position.
Figure 8:
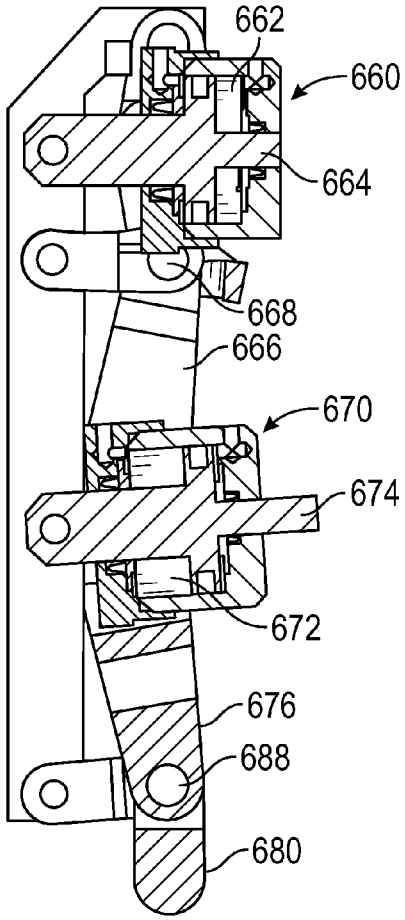
FIG. 8 shows a cross-section of the levers of FIG. 6, wherein the upper lever is in the inactive position and the lower lever in the active position.

FIG. 7 shows a cross-section of the drive device 650 wherein the upper lever action device 660 is in an active position and the lower lever action device 670 is in an inactive position. FIG. 8 shows a cross-section of the levers of FIG. 6, wherein the upper lever is in the inactive position and the lower lever in the active position. Referring to FIGS. 7 and 8, the lever action device 660 includes a fluid chamber 662 and a reciprocation piston 664 in the chamber 662, while the lever action device 670 includes a fluid chamber 672 and a piston 674. The lever action device 660 is coupled to lever action device 670 by a lever 666 about pivot points 668 and 678. The lever action device 670 is further coupled to the pin 680 via a lever 678 about pivot point 678 and 688. When a fluid under pressure is supplied to chamber 662, the piston 664 moves outward, which movement in turn moves the lever 666 radially outward, as shown in FIG. 7. Similarly, when the fluid under pressure is supplied to chamber 672, the piston 674 moves outward, as shown in FIG. 8, which action causes the lever 674 to move inward, as shown in FIG. 8. The vertical or linear motion of the lever causes the pin to move along with the lever 674. By articulating the supply of the fluid to the lever action devices 660 and 670 the amount of the linear movement of the pin 680 and hence the pads (242*a* and 242*b* of FIG. 2) may be controlled. A controller in the drill bit, bottomhole assembly and/or at the surface may be programmed to control the motor (610, FIG. 3) to control the linear movement of the levers 660 and 670 to control the extension and retraction of the pads 242*a* and 242*b*, FIG. 2. Although two lever action devices 660 and 670 are shown, the force application device 600 may include any desired number of such devices.

The concepts and embodiments described herein are useful to control the axial aggressiveness of drill bits, such as a PDC bits, on demand during drilling. Such drill bits aid in: (a) steerability of the bit (b) dampening the level of vibrations and (c) reducing the severity of stick-slip while drilling, among other aspects. Moving the pads up and down changes the drilling characteristic of the bit. The electrical power may be provided from batteries in the drill bit or a power unit in the drilling assembly. A controller may control the operation of the motor and thus the extension and retraction of the pads in response to a parameter of interest or an event, including but not limited to vibration levels, torsional oscillations, high torque values; stick slip, and lateral movement.

The foregoing disclosure is directed to certain specific embodiments for ease of explanation. Various changes and modifications to such embodiments, however, will be apparent to those skilled in the art. It is intended that all such changes and modifications within the scope and spirit of the appended claims be embraced by the disclosure herein.

The invention claimed is:

1. A drill bit, comprising:

a member configured to extend and retract from a face section of the drill bit; and a force application device in the drill bit configured to extend and retract the member from the face section of the drill bit, the force application device including a drive device that includes a lever action device, wherein the lever action device includes a lever operatively coupled to the member and a piston coupled to the lever, wherein a motion of the piston in a radial direction causes the member to extend and retract from the face section of the drill bit along an axis of the drill bit.

2. The drill bit of claim 1, wherein the lever action device is hydraulically operated to move the lever.

3. The drill bit of claim 2, wherein the lever action device includes a fluid chamber and the piston in the fluid chamber, wherein the piston moves when a fluid under pressure is supplied to the chamber to move the lever in order to extend or retract the member.

4. The drill bit of claim 2 further comprising a motor and a pump configured to supply a fluid under pressure to the lever action device.

5. The drill bit of claim 1 further comprising a drive unit coupled to the member, wherein the drive unit causes the member extend when a force is applied to the drive unit.

6. The drill bit of claim 5, wherein the drive unit includes a a biasing member configured to cause the member to retract when force is released from the drive unit.

7. The drill bit of claim 1 further comprising a sensor configured to provide signals relating to the extending and retracting of the member.

8. A drilling apparatus comprising:

a drilling assembly including a drill bit configured to drill a wellbore, wherein the drill bit further comprises:

a member configured to extend and retract from a face section of the drill bit; and a force application device in the drill bit configured to extend the member from the face section of the drill bit, the force application device including a drive device that includes a lever action device, wherein the lever action device includes a lever operatively coupled to the member and a piston coupled to the lever, wherein a motion of the piston in a radial direction causes the member to extend and retract from the face section of the drill bit along an axis of the drill bit.

9. The drill bit of claim 8, wherein the lever action device is hydraulically-operated to move a lever operatively coupled to the member.

10. The drill bit of claim 9, wherein the lever action device includes a fluid chamber and piston in the fluid chamber, wherein the piston moves when a fluid under pressure is supplied to the chamber to move the lever that is operatively coupled to the member to extend or retract the member.

11. A method of making a drill bit comprising:

providing a bit body having a member configured to extend from a face section thereof;

providing a force application device in the drill bit configured to extend the member from the face section of the drill bit, the force application device including a drive device that includes a lever action device, wherein the lever action device includes a lever operatively coupled to the member and a piston coupled to the lever; and moving the piston in a radial direction to cause the member to extend and retract from the face section of the drill bit along an axis of the drill bit.

12. The method of claim 11, wherein the lever action device is hydraulically operated to move a lever operatively coupled to the member.

13. A method of drilling a wellbore, comprising:

conveying a drill string into a wellbore, the drill string including a drill bit at an end thereof, wherein the drill bit includes a member configured to extend and retract from a face section of the drill bit, and a force application device configured to extend the member from the face section of the drill bit, the force application device includes a drive device that includes a lever action device, wherein the lever action device includes a lever operatively coupled to the member and a piston coupled to the lever;

moving the piston in a radial direction to cause the member to extend from the face section of the drill bit along an axis of the drill bit; and drilling the wellbore with the drill string with the member extended from the face section of the drill bit.

* * * * *